United States Patent [19]

Tashiro et al.

[11] Patent Number: 4,984,915

[45] Date of Patent: Jan. 15, 1991

[54] WEB HOLDING DEVICE

[75] Inventors: Takeshi Tashiro, Shizuoka; Ikuzo Sugiura, Kanagawa, both of Japan

[73] Assignee: Tokyo Electric Co., Ltd., Tokyo, Japan

[21] Appl. No.: 396,125

[22] Filed: Aug. 21, 1989

[30] Foreign Application Priority Data

Aug. 23, 1988 [JP] Japan ..... 63-110249
Jun. 28, 1989 [JP] Japan ..... 1-165570

[51] Int. Cl.[5] ..... B41J 15/02; B41J 15/04

[52] U.S. Cl. ..... 400/613; 400/242; 242/55.2

[58] Field of Search ..... 400/207, 208.1, 236, 400/242, 247, 225, 613, 594; 101/336; 242/55.2, 58, 68.3

[56] References Cited

U.S. PATENT DOCUMENTS 3,701,318 10/1972 Lozeau et al. ..... 101/336

FOREIGN PATENT DOCUMENTS 59-162079 9/1984 Japan ..... 400/242
61-188172 8/1986 Japan ..... 400/242
62-56178 3/1987 Japan ..... 400/236

*Primary Examiner*—David A. Wiecking
*Assistant Examiner*—Motilal P. Patel
*Attorney, Agent, or Firm*—Oblon, Spivak, McClelland, Maier & Neustadt

[57] ABSTRACT

A web holding device in which elastic pieces of tapered form projecting out towards a bearing and expanding in the outer peripheral direction are formed on a web driving shaft which is coupled with a driving unit and rotatably supported at one end on a frame; and a core having an engaging section formed at one end is mounted on the web driving shaft, such that the core is retained by a contact portion formed on the end of each of the elastic pieces.

10 Claims, 5 Drawing Sheets

WEB HOLDING DEVICE

FIELD OF THE INVENTION AND RELATED ART STATEMENT:

The present invention relates to a web holding device such as an ink ribbon used in printers.

One example of this type of conventional web holding device is shown in FIG. 9. In a label printer in which printing is done on a label paper 32 and an ink ribbon 1 which are passed in one direction between a platen 30 and a thermal head 31, a ribbon tube 33 carrying the ink ribbon 1 is mounted on a shaft 34, 35, at least one shaft 34 being driven by power from a motor. To transmit the turning force to the ribbon tube 33, a plurality of splines 36 are formed integral on the outer periphery of the shaft 34, 35, and a plurality of grooves 37 to be in mesh with the splines 36 are formed in the inner peripheral surface of the ribbon tube 33. In the web holding device of the above-described constitution, when the ribbon tube 33 is to be mounted, it is necessary to fit the splines 36 formed on the shaft 34, 35 in the grooves 37 formed in the ribbon tube 33 as shown in FIG. 10. In this case, therefore, the installation of the ribbon tube 33 can not smoothly be effected. Moreover, the engagement of the splines with the grooves is not visible to the installer, so that this work becomes a hard, fumbling task.

Furthermore, for providing a plurality of grooves 37 in the inner peripheral surface of the ribbon tube 33, the ribbon tube 33 must be thick enough to form the grooves. Generally, therefore, the ribbon tube 33 is produced of synthetic resin. However, since both the ribbon tube 33 and the ink ribbon 1 are consumable, many ribbon tubes 33 are needed, resulting in a high running cost to a user.

OBJECTS AND SUMMARY OF THE INVENTION:

A first object of the present invention is to facilitate the installation of a core to a web driving shaft.

A second object of the present invention is to enhance the installation stability of the core to the web driving shaft.

A third object of the present invention is to enable the use of a core produced of a low-cost material such as paper.

Other and further objects of the present invention will become obvious from the following description.

The above, and other, objects are achieved according to the present invention by a web holding device for a web wound on a core having an engaging section at one end thereof. The web holding device includes a web driving shaft coupled with a driving unit and rotatably supported at one end on a frame. An engaging projection section is formed at the one end of the web driving shaft closest to the frame for engagement with the engaging section of the core when the core is counted on the web driving shaft with the engaging section facing the frame. According to one embodiment, a plurality of tapered elastic pieces having one end connected to another end of the web driving shaft project toward another end thereof in a direction radially outward and toward the one end of the web driving shaft. According to another embodiment, there is provided a sliding shaft slidably mounted on the web driving shaft for sliding movement along the length of the web driving shaft, and means for biasing the sliding shaft toward the one end of the web driving shaft. A plurality of tapered elastic pieces have one end connected to the sliding shaft and project from that one end toward another end in a direction radially outward and toward the one end of the web driving shaft. The other ends of the tapered elastic pieces comprise contact portions which contact an end of the core opposite the engaging section when the core is so mounted on the web driving shaft.

It is, therefore, possible to transmit the turning force of the web driving shaft to the core by engaging the engaging projection with the engaging section when the core is inserted into the web driving shaft. Also, when the core is inserted into the web driving shaft, the elastic pieces projecting in the outer peripheral direction press the end of the core with elasticity of their own, thereby securing the core in the axial direction and accordingly automatically retaining the core to prevent core disengagement in the axial direction. Furthermore, the core is provided with an engaging section at the end to receive the turning force from the web driving shaft. It is therefore possible to use a low-cost, thin-wall cylindrical core made of paper or the like.

Figure 1:
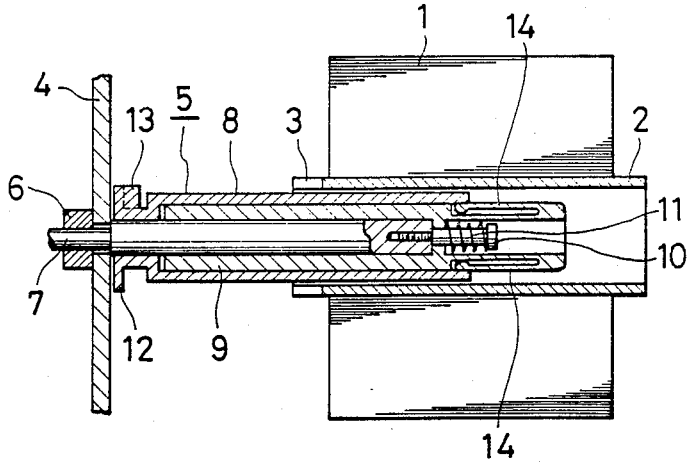
FIG. 1 is a longitudinal sectional view of a first embodiment of the present invention showing the process of core installation to a ribbon driving shaft.

DETAILED DESCRIPTION OF PREFERRED EMBODIMENT:

The first embodiment of the present invention will now be described with reference to FIGS. 1 to 5. Numeral 1 denotes a wide and long ink ribbon as a web. The cylindrical paper core 2 wound with this ink ribbon 1 thereon has at one end an engaging section 3 formed to fasten the starting end of the ink ribbon 1 and to rotate the core 2. This engaging section 3 is provided with a plurality of square cutouts formed in the end of the core 2. Numeral 4 is a printer frame, which is only partly illustrated. On this frame is rotatably supported at one end the ribbon driving shaft as a web driving shaft. This ribbon driving shaft 5, which is rotatably supported on a bearing 6 secured on the frame 4, is composed of a rotating shaft 7 coupled to a motor (not shown), and outer tube 8 fixedly installed on the outer periphery of this rotating shaft 7. A sliding shaft 9 is locked from turning on the rotating shaft 7 and slidably fitted thereon in the axial direction. On a flanged bolt 10 screwed in the forward end of the rotating shaft 7, a spring 11 for pressing the sliding shaft 9 towards the frame 4 and the one end of the shaft 5 is mounted. Furthermore, at the root of the outer tube 8 a flange 12 having one or a plurality of engaging projections 13 engaged with the engaging section 3 is mounted. The sliding shaft 9 is an elastic synthetic resin molding. At the end of this shaft are formed a plurality of tapered elastic pieces 14 which expand from their one ends attached to the sliding shaft 9 towards the bearing 6 of the rotating shaft 7, i.e., toward the one end of the shaft 5, and open radially outward due to their own elasticity. These elastic pieces 14 are provided at their other ends with a contact section 15 which comes in contact with the end of the core 2.

Figure 2:
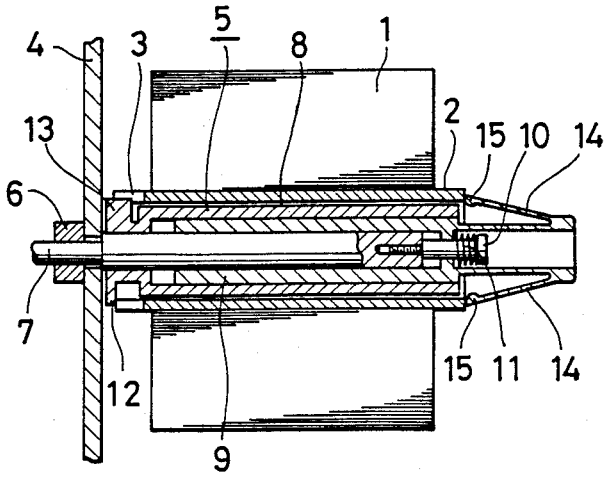
FIG. 2 is a longitudinal sectional view showing the core installed on the ribbon driving shaft.
Figure 3:
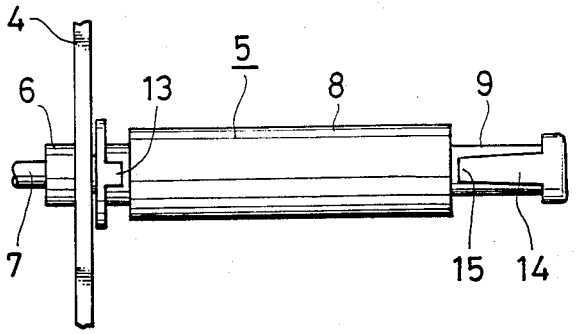
FIG. 3 is a plan view showing the ribbon driving shaft in installed state.
Figure 4:
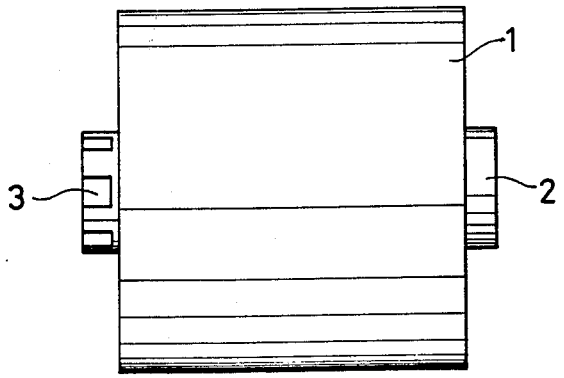
FIG. 4 is a plan view of an ink ribbon wound on the core.
Figure 5:
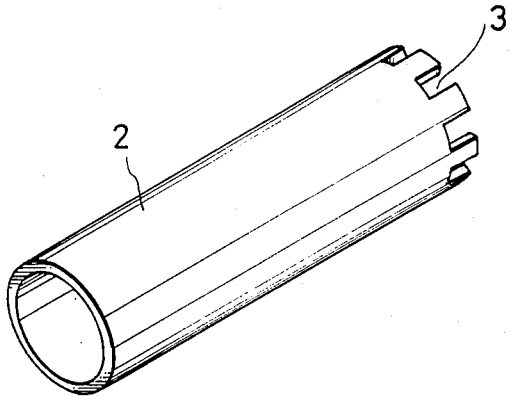
FIG. 5 is a perspective view of the core.

In the web holding device of the above-described constitution, as shown in FIG. 1, the sliding shaft 9 is usually being pressed by the spring 11 towards the frame 4 side, and accordingly the elastic pieces 14 are fitted inside of the outer tube 8. In this state, the core 2 can be inserted over the ribbon driving shaft 5 as far as the frame 4 side without any resistance of the elastic pieces 14. With the engaging projections 13 properly aligned with the cutouts of the engaging section 3, the core 2 is fully inserted over the ribbon driving shaft 5. The sliding shaft 9 is then pulled against the force of the spring 11, and the elastic pieces 14 open back outwardly due to their elasticity. In this state, as shown in FIG. 2, the contact section at the end presses the end of the core 2, preventing the axial movement of the core 2. Therefore, when the rotating shaft 7 is turned with a power from the motor, the rotation of the rotating shaft 7 is transmitted to the outer tube 8 and the sliding shaft 9 and, furthermore, to the core 2 through the coupled section of the engaging projections 13 and the engaging section 3.

Since the core 2 can receive the turning force from the ribbon driving shaft 5 through the engaging section 3 formed at the end thereof as described above, a low-cost, thin-wall, cylindrical paper core 2 can be used. Besides, the design that the engaging section 3 formed for the purpose of fastening the end of the ink ribbon 1 is engaged with the engaging projections 13 of the ribbon driving shaft 5 can further reduce the cost without complicating the construction of the core 2. Furthermore, since the elastic pieces 14 are formed at the end of the sliding shaft 9 pressed in the direction of contraction, the axial movement of the core 2 can be prevented if its length varies within manufacturing tolerance.

Figure 6:
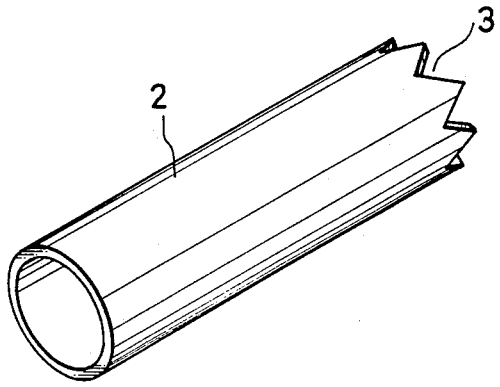
FIG. 6 is a perspective view showing an example of variation of the core.

FIG. 6 shows an example of a variation of the core 2, in which the engaging section 3 is formed with V-shaped cutouts. In this case, the engaging projections 13 on the ribbon driving shaft 5 side are also formed in the V shape.

Figure 7:
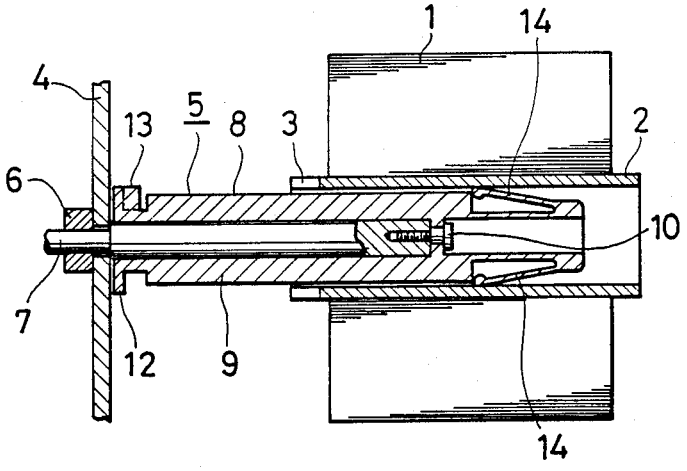
FIG. 7 is a longitudinal sectional view of a second embodiment of the present invention showing the process of core installation to the ribbon driving shaft.
Figure 8:
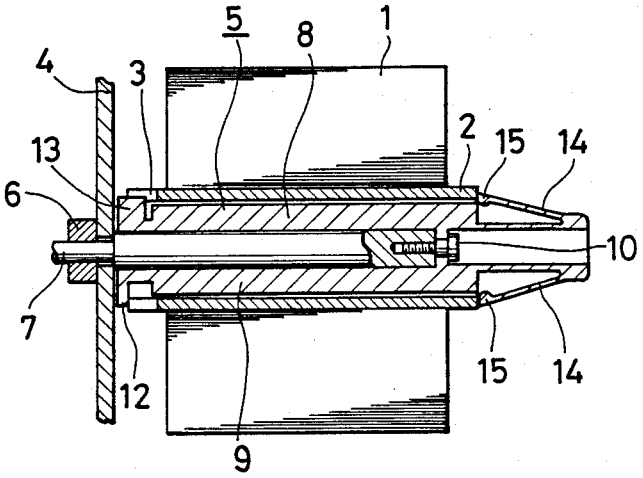
FIG. 8 is a longitudinal sectional view showing the core installed on the ribbon driving shaft.
Figure 9:
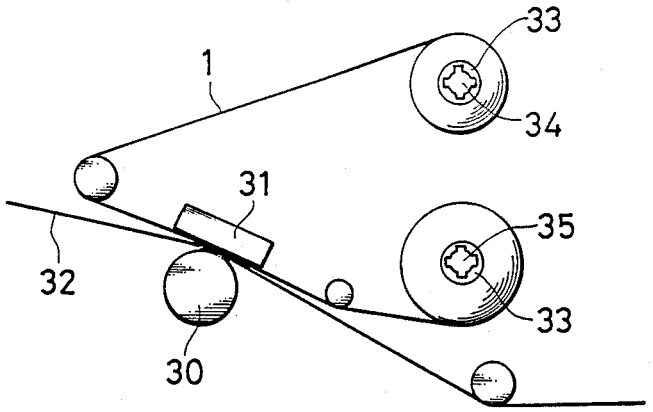
FIG.9 (PRIOR ART)
FIG. 9 :s a side view showing the structure of a label printer in conventional use.
Figure 10:
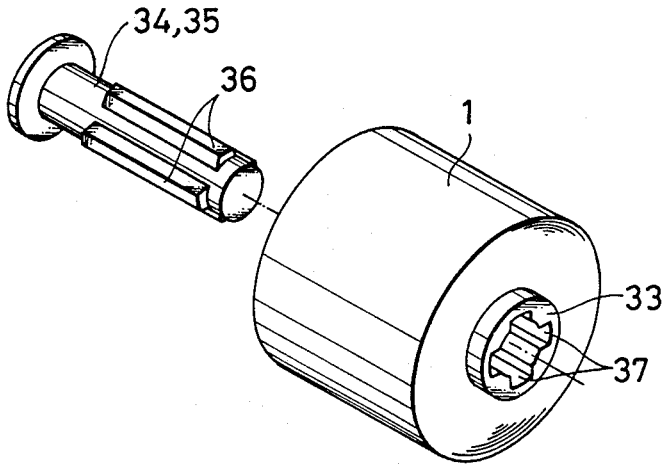
FIG.10 (PRIOR ART)
FIG. 10 is a perspective view showing the ribbon driving shaft and the ribbon tube.

Furthermore, the second embodiment of the present invention will be explained by referring to FIGS. 7 and 8, in which the same numerals as in the above-described embodiment will be used for the same parts. According to the second embodiment, the outer tube 8 is formed integral with the sliding shaft 9. This outer tube 8 is secured to the rotating shaft 7 by the flanged bolt 10. The elastic pieces 14 are symmetrically arranged in relation to the axial center of the rotating shaft 7, and, in a usual state, are tapered, projecting towards the bearing 6 of the rotating shaft 7 and expanding radially outward.

In the web holding device of the above-described constitution, when the core 2 is inserted, the elastic pieces 14, being tapered, insure smooth core insertion. When the core 2 has reached a proper position with the engaging section 3 engaged with the engaging projections 13, the elastic pieces 14 deflected towards the center by the core 2 are freed from the inner surface of the core 2, thus automatically opening back outwardly until the contact section 15 comes in contact with the end of the core 2. The core 2, therefore, can be locked from turning and held from slipping off the ribbon driving shaft 5.

In the first embodiment described above, since the sliding shaft 9 is pressed by the spring 11, the core 2 will not move in the axial direction if a slight variation exists in axial length. In the present embodiment, there is the necessity of maintaining dimensional accuracy within a range in which the axial movement of the core 2 is permitted. Actually, however, the core 2, being allowed to have a substantial amount of axial play, can be manufactured without affecting the accuracy of the device and the dimensional accuracy of the core 2.

The core 2 thus installed can be pulled off by inwardly pushing to deflect the elastic pieces 14 towards the center.

In either embodiment, the engaging section 3 may be provided with one cutout and one engaging projection may be formed to fit in the cutout.

What is claimed is:

1. A web holding device for a web wound on a core having an engaging section at one end thereof, comprising:

a frame and a driving unit;

a web driving shaft coupled with said driving unit and rotatably supported at one end on said frame;

an engaging projection section formed at said one end of said web driving shaft closes to the frame, for engagement with the engaging section of the core when the core is mounted on said web driving shaft with the engaging section facing the frame; and a plurality of tapered elastic pieces, each of said tapered elastic pieces having one end connected to another end of said web driving shaft, each of said tapered elastic pieces having another end, and projecting from said one end thereof to said another end thereof in a direction radially outward and toward said one end of said web driving shaft, whereby said another ends of said tapered elastic pieces comprise contact portions which contact an end of the core opposite the engaging section when the core is mounted on said web driving shaft.

2. A web holding device for a web wound on a core having an engaging section at one end thereof, comprising:

a frame and a driving unit;

a web driving shaft coupled with said driving unit and rotatably supported at one end on said frame;

an engaging projection section formed at said one end of said web driving shaft closest to the frame, for engagement with the engaging section of the core when the core is mounted on said web driving shaft with the engaging section facing the frame;

a sliding shaft slidably mounted on said web driving shaft for sliding movement along the length of said web driving shaft;

means for biasing said sliding shaft towards the one end of said web driving shaft; and a plurality of tapered elastic pieces, each of said tapered elastic pieces having one end connected to said sliding shaft, each of said tapered elastic pieces having another end, and projecting from said one end thereof to said another end thereof in a direction radially outward and toward said one end of said web driving shaft, whereby, said another ends of said tapered elastic pieces comprise contact portions which contact an end of the core opposite the engaging section when the core is mounted on said web driving shaft.

3. A web holding device as claimed in claim 1, wherein said elastic pieces are formed integral with said web driving shaft.

4. A web holding device as claimed in claim 1 or 2 wherein said elastic pieces are symmetrically formed in relation to the axial center of said web driving shaft.

5. A web holding device as claimed in claim 1 or 2, wherein said engaging section and said engaging projection section respectively comprise a plurality of V-shaped cutouts in the core and a plurality of projections on said web driving shaft.

6. A web holding device as claimed in claim 1 or 2, wherein said engaging section comprises a plurality of cutouts in the core.

7. A web holding device as claimed in claim 6 wherein the core comprises a cylindrical core and wherein said engaging projection section comprises a plurality of projections.

8. A web holding device as claimed in claim 13, wherein said elastic pieces are symmetrically formed in relation to the axial center of said web driving shaft.

9. A web holding device as claimed in claim 7, wherein a plurality of said cutouts are formed all around said one end of the core.

10. A web holding device as claimed in claim 13, wherein said cutouts and said projections are V-shaped.

* * * * *